United States Patent [19]

Greenwood

[11] Patent Number: 4,480,889

[45] Date of Patent: Nov. 6, 1984

[54] ADAPTER AND METHOD FOR TAPPING OR SPLICING FLAT MULTICONDUCTOR CABLE

[75] Inventor: William S. Greenwood, Nutley, N.J.

[73] Assignee: Thomas & Betts Corporation, Raritan, N.J.

[21] Appl. No.: 337,662

[22] Filed: Jan. 7, 1982

[51] Int. Cl.[3] ..... H01R 13/39

[52] U.S. Cl. ..... 339/99 R; 339/14 R

[58] Field of Search ..... 339/14, 97 R, 97 P, 339/98, 99 R

[56] References Cited

U.S. PATENT DOCUMENTS

| | | | |
|---|---|---|---|
| 2,964,587 | 12/1960 | Minot | 174/117 |
| 3,154,363 | 10/1964 | Will | 339/99 R |
| 3,736,627 | 6/1973 | Sosinski | 339/98 |
| 3,761,867 | 9/1973 | Churla | 339/98 |
| 3,891,293 | 6/1975 | Jones | 339/97 |
| 3,935,637 | 2/1976 | Bunnell | 339/99 R |
| 4,219,928 | 9/1980 | Kuo | 29/868 |

FOREIGN PATENT DOCUMENTS

| | | | |
|---|---|---|---|
| 1924964 | 12/1969 | Fed. Rep. of Germany | 339/98 |
| 717319 | 10/1954 | United Kingdom | 339/98 |

*Primary Examiner*—Joseph H. McGlynn

*Attorney, Agent, or Firm*—Robert M. Rodrick; Salvatore J. Abbruzzese

[57] ABSTRACT

An adapter is employed for effecting a tap or splice to a flat conductor cable main at the same location where an electrical receptacle is to be installed. The adapter includes a substantially elongate body of insulating material having two opposing surfaces. Plural contact means are spaced longitudinally on the body, the contact means having insulation piercing members extending outwardly therefrom and projecting beyond each of the opposing body surfaces.

15 Claims, 8 Drawing Figures

ADAPTER AND METHOD FOR TAPPING OR SPLICING FLAT MULTICONDUCTOR CABLE

FIELD OF THE INVENTION

The present invention relates to a method and adapter for use in making an electrical tap or splice to insulated, flat multiconductor cable.

BACKGROUND OF THE INVENTION

Flat conductor cable (FCC) underlying carpet tiles is in present use to supply electrical power to various points of use, as for example, handling lighting and appliance loads in commercial buildings. The flat conductor cable includes in a common form thereof a plurality of flat conductors i.e., live, neutral and grounding conductors encased in a plastic electrically insulative casing and additionally having a metallic shield disposed at the upper surface of the cable. A layer typically made of tough insulation material is provided on the bottom of the cable as an abrasion protection shield. The metallic shield is electrically grounded to provide against electrical hazard such as accidental piercing of the shield and the live conductor by an object, which object since the shield is connected to ground, is rendered unhazardous to a person who might contact same. An advantage of the use of this type of conductor cable is the facility with which it can be installed beneath carpeting and carpet tiles while at the same time allowing for transfer of power therefrom at selected locations, pedestals or transfer receptacles being installed for such purpose.

Various specialized types of devices including receptacles are known for establishing power take-off from the flat conductor cable at a given location as well as for effecting splicing of a branch line to a main. Thus, for connecting a receptacle at a desired location, a terminal block carrying insulation piercing members or contacts can be secured over the flat conductor cable with the contacts piercing the flat conductor cable to establish continuity with the respective cable conductors. A receptacle can then be placed over the terminal block with suitable connection between the terminals of the block and contact points in the receptacle being made with round wire connectors. With such installation the cable run can be terminated at the take-off location or it may pass through the terminal block so that additional receptacles can be connected further down the line. It is also known to use for purposes of providing power take-off, a receptacle which embodies insulation piercing contacts therein and employed when installed directly over a conductor cable to have these piercing contacts electrically connectively engage the conductors in the cable.

With respect to flat conductor cable wiring systems and while it is known how to and with what devices to tap a main to establish a branch line or to effect splicing of lines no such technique or simplified device has been provided which will allow a tap or a splice to be made at the same location where a flat conductor cable receptacle is present, i.e. directly under the receptacle.

SUMMARY OF THE PRESENT INVENTION

The present invention relates to improvements in a method and device for making a tap or splice at a pedestal in an electrical wiring system.

It is an object of the present invention to provide a method and device which will enable cable taps or wiring splices to be made to a flat conductor cable and being particularly suited for use with a receptacle designed for direct attachment to the cable.

Another object is to have the device installable at a pedestal using the direct attachment type receptacle either at the time of original pedestal installation or at a later date to add to the original circuit.

Still further objects are to have the device removable and yet be able to maintain the pedestal at which it had been installed; to have both the device and receptacle removable from the circuit without losing the ability to maintain any tap or splice which may have been located there by installing standard connectors and an insulator; to provide the device as a unitized assembly installable as one piece; to have the device installable with a minimal amount of special cable preparation and without the need of special application tools; and to limit the amount of cable preparation, i.e., removal of the protective coverings or shields which are over the insulated conductors of the flat cable.

In accordance with the present invention, a method and device are provided with which a cable tap or splice can be made at a location at which a flat conductor cable receptacle is installed. For this purpose a special tap and splice adapter device is used. The device comprises a relatively elongated, thin holder of electrically insulative material having marginal configuration like that of the above-mentioned receptacle, the holder carrying insulation piercing type contacts arranged in such positioning, e.g., corresponding to the live, neutral and grounding contact means in the receptacle, as to superpose over the live, neutral and grounding conductors in the cable when placed over the cable during the splice installation. The insulation piercing teeth of the respective contacts in the holder are located at both the bottom and top sides of the holder and the overall thickness of the contacts is greater than that of the holder. The holder is also provided with features such as notches and a telltale which must be properly registered with companion structure on the support member and the overlying receptacle in order to effect proper installation and orientation of the device in the intended manner. To make a splice connection, a support member is placed under the flat cable main at the location from which the splice is to be taken, the shield at the top side of the main is removed from over the live and neutral conductors of the cable and the device then placed on top of the main with the live, neutral and grounding contacts therein in registry with the associated cable conductors. The branch cable to be spliced to the main is then superposed over the main, i.e., with its conductors in longitudinal registry with those in the main and the shield at the top side of the branch removed from the live and neutral conductors at locations in registry with the like removed shield areas of the main. Similarly, the bottom abrasion protection shield is removed preferably across the width of the cable at a location in registry with the top shield removal. A receptacle, e.g., of the type described in the concurrently filed, commonly owned application entitled, "Receptacle for Flat Multiconductor Cable", is then received on top of the branch cable and fastened with screws to the support member. Such fastening will result in the cable piercing contact portions at the bottom and top of the device piercing respectively, the insulation and conductors of the main from the top side thereof and the insulation and condctors of the branch from the bottom side thereof. The device contacts associated with the grounding conductor will pierce the protective shield at the top of the main, and the grounding contact at the topside of the device will pass through insulation and engage the branch grounding conductor in the branch. The fastening also will result in the insulation piercing contact portions at the bottom of the receptacle piercing the insulation over the branch live and neutral conductors and coming into contact with such conductors. The grounding conductor associated contact in the receptacle will of course pierce the protective shield of the branch, the insulation over the grounding conductor and firmly and positively contact the grounding conductor itself, establishing grounding circuit continuity in the main, branch, adapter device and the receptacle. The run of the branch can then be carried out in any intended direction with the branch being first folded in the manner taught in U.S. Pat. No. 4,219,928 to provide that the protective shield of the branch is disposed at the topside of the branch.

The invention accordingly comprises the adapter device having the features of construction, combination of elements and arrangements of parts and the steps of effecting a splice or tap as will be exemplified in the construction and description hereinafter set forth and the scope of the invention will be indicated in the claims.

BRIEF DESCRIPTION OF THE DRAWINGS

A fuller understanding of the nature and the objects of the present invention will be had from the following detailed description taken in conjunction with the accompanying drawings in which.

Throughout the description, like reference numerals are used to denote like parts in the drawings.

DESCRIPTION OF THE PREFERRED EMBODIMENTS

Figure 1:
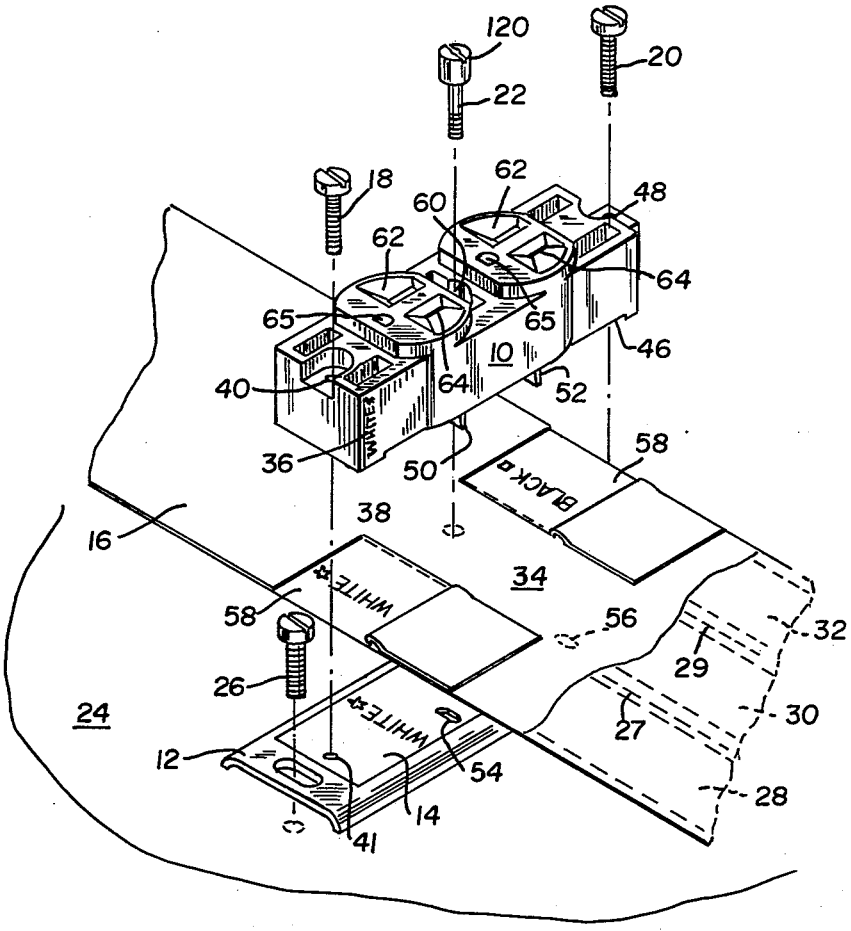
FIG. 1 is an exploded view in perspective showing the relative positioning of the components employed to effect pedestal installation for a flat conductor cable at a desired location, such components including the improved receptacle described in the aforementioned concurrently filed application.

Referring to FIG. 1, the assembly of components used for installing a flat conductor cable receptacle 10 at a given location in a flat conductor cable wiring circuit includes in addition to the receptacle 10, a support member 12 including an insulated covering 14 preferably secured to the support member and the flat conductor cable 16 and the respective end fastener screws 18, 20 and a grounding fastener screw 22. Support member 12 with the insulated covering 14 is adapted to be secured to, e.g., a floor surface 24 with securement screws 26 at each end, only one such securement screw being shown in FIG. 1. Flat conductor cable 16 is of a known type, e.g., that disclosed in U.S. Pat. No. 4,219,928 and includes respective laterally spaced live, grounding and neutral conductors 28, 30, 32 encased in an insulative covering having perforations 27 and 29 separating the conductors and surmounted by a metallic protective shield 34. A layer of abrasion resistant material (not shown) is preferably on the bottom of the cable 16. The receptacle 10 carries indicia as at 36 which are cooperative with like indicia 38 on the cable indicative of proper receptacle orientation to insure correct polarity of electrical connections to be made. Further in this regard and to insure proper placement orientation of the receptacle on the cable, the receptacle has a fastener screw through passage 40 which functions as a telltale cooperative with like telltale openings 41 in insulated covering 14 and support member 12 when correct receptacle placement is effected to indicate such condition and thereby allow screw 18 to pass through for securement of the receptacle to the support member. As an additional feature designed to eliminate possibility of improper receptacle orientation on the cable, the side walls 42, 44 (FIG. 2) of the receptacle have their lower edges notched upwardly as at 46 for an intermediate distance between the receptacle ends with the termini of the notches in close fitting embrace with the opposite side edges of the cable and demarking the cable lateral extremities. One terminus of each notch is located closer to its associated receptacle end than the other terminus to its associated receptacle end. When therefore the receptacle is placed over the cable in correct orientation and hence proper polarity, the passage 40 will align with openings 41. If the receptacle was installed with a reciprocal orientation, the notches 46 would fit the cable snuggly but the passage 48 associated with fastener screw 20 would not align with openings 41 and screw 18 could not be inserted through the complete assembly. Notches 46 also accomodate the thickness of the flat cable and provide space in which the soon to be described receptacle insulation piercing contact means first portions are disposed. Another safeguard that insures that proper orientation must be employed to install the receptacle is provided by tabs 50, 52 at the underside of the receptacle which must pass through the cable preferably at the perforations 27 and 29 between the grounding conductor 30 and the live and neutral conductors and be received in openings 54, 56 in the insulated covering 14 and support member 12 in order for the receptacle to seat properly. If reciprocal orientation were attempted, the tabs would not line up with openings 54, 56 and hence not pass therethrough preventing proper seating. The receptacle is provided at the topside thereof with a generally centrally disposed passage 60 receptive of grounding fastening screw 22 and also with openings 62, 64 for receiving appliance plug prongs associated with power transfer, and openings 65 associated with the plug grounding prongs.

With continued reference to FIG. 1, the protective metallic or grounding shield 34 on top of cable 16 will as a preliminary to connecting the receptacle thereto be removed or cut and laid back in the rectangular pattern as at 58 in regions overlying the live and neutral conductors 28, 32 in the cable leaving exposed the insulative covering in which said conductors are encased. It is preferrable that the shield be cut and laid back by folding same rightwardly on top of uncut portions of the shield since this facilitates effecting repair to the shield in the event the receptacle is removed. More specific consideration of receptacle 10 will be given next and with continuing reference to FIGS. 2–4.

Figure 6:
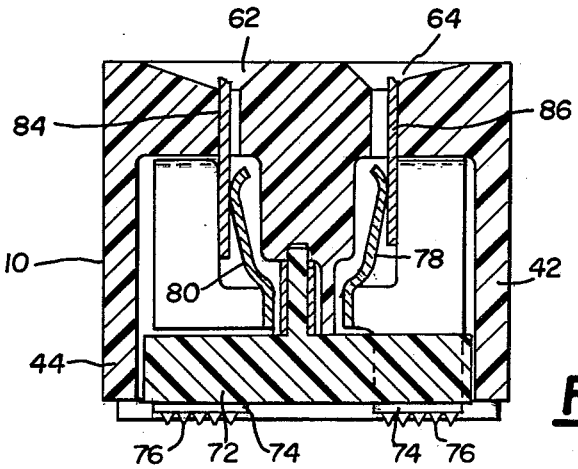
FIG. 6 is a transverse sectional view of the receptacle as taken along the lines VI—VI of FIG. 3.
Figure 2:
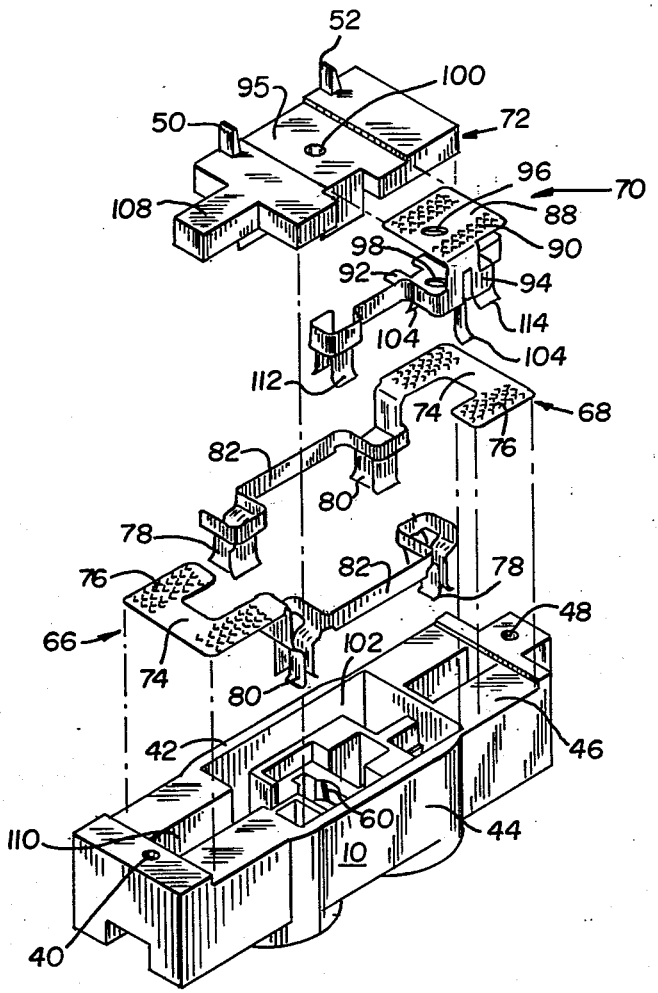
FIG. 2 is an exploded bottom perspective view of the receptacle shown in FIG. 1 illustrating the grounding contact support block and the cable live, neutral and grounding conductor associated contacts and the manner in which such contacts are positioned in the receptacle body.

Receptacle 10 is an elongated body made of electrically insulative material formed preferably as a molded structure of generally rigid durable character. Formed within the molded structure at the underside thereof are suitable conformably configured grooves for receiving the flat cable live conductor associated contact means 66 and the cable neutral conductor associated contact means 68. As FIG. 2 illustrates, the cable grounding conductor associated contact means 70 is carried on a support block 72 which shall be described in greater detail shortly. The contact means 66, 68 are identically configured members. Each of said contact means has a first contact portion 74 in the form of a thin broadened plate-like member and fitted with insulation piercing teeth 76 struck from the plate material in the manner, e.g., described in U.S. Pat. No. 3,549,786. The first portions of these contact means when such means are in retained position in the receptacle body are disposed at the underside of the receptacle and in facing relation to the flat cable on which the receptacle is positioned, the first portion of one contact means adjacent one end of the body and the first portion of the other adjacent the other body end. Each contact means also has a second contact portion which extends upwardly in the receptacle towards its top side and communicating with the body openings 62, 64. Such second contact portions desirably are formed as two like branches 78, 80 joined by a bus 82. The two branches of each of the respective live and neutral contact means cooperate to form two pairs of prong receiving contacts to transfer power to two appliances. FIG. 6 illustrates how these branches 78, 80 are diposed in the receptacle body and how two external power prongs 84, 86 of a plug are engaged therewith.

Figure 5:
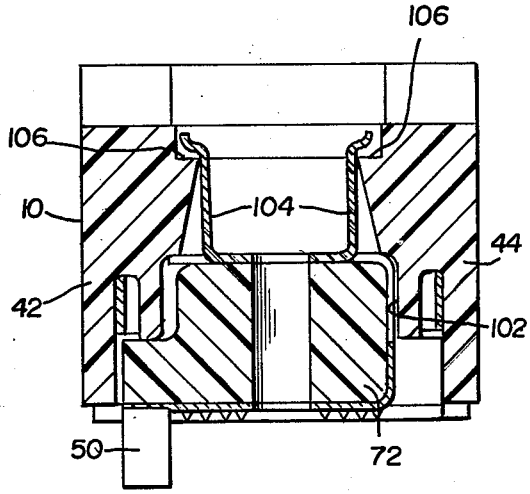
FIG. 5 is an enlarged view of the FIG. 4 illustration with the cover, screw fastener and support member removed and as seen from the opposite direction of the FIG. 4 view.

FIG. 2 further shows that grounding contact means 70 is a single piece, shaped member having a first plate-like contact portion 88 also fitted with insulation piercing teeth 90, a spaced plate-like extension 92 joined by strut 94 to portion 88 and forming a skirt embracing the support block 72 with portion 88 being received in slot 95 of the block. Grounding contact means 70 also includes the like branch contact pieces 112, 114 which receive the grounding prongs on appliance plugs inserted into the receptacle, such contact pieces being in communication with body openings 65. This contact means also includes openings 96, 98 alignable with opening 100 in the block and through which openings the main shaft length of grounding fastener screw 22 passes. To accomodate support block 72, the receptacle body has an enlarged generally centrally disposed upwardly opening recess 102, the block closely fitting within the recess but yet being moveable upwardly and downwardly therein. For retaining the support block within the receptacle body, the grounding contact means is provided with flexible fingers 104 which extend upwardly in the body to engage with body detent shoulders 106 (FIG. 5) and hold the block captively but moveably retained in the receptacle body. Support block 72 also is provided at one end with a tongue-like extension 108 which is received in groove 110 of the receptacle body for properly orienting the support block when assembling same with the body, and also carries the alignment tabs 50, 52 referred to above and used in effecting alignment of the receptacle in proper orientation on the cable.

Figure 4:
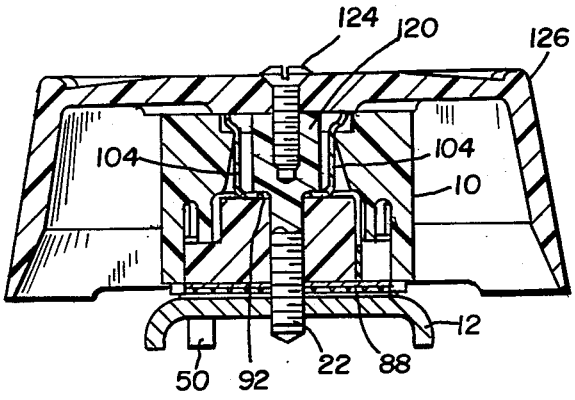
FIG. 4 is a transverse central sectional view in elevation of the receptacle as seen along lines IV—IV of FIG. 3 with the receptacle cover in place.
Figure 3:
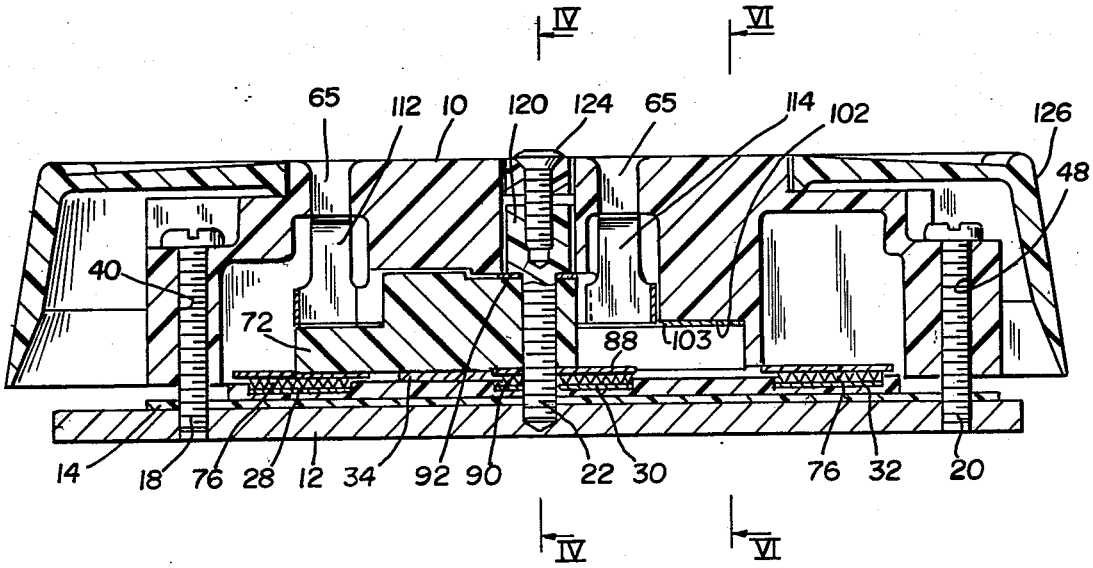
FIG. 3 is a longitudinal central sectional view in elevation depicting the manner in which the receptacle is connected to the support member and further the manner in which the grounding screw is employed to urge the grounding contact means into electrically conductive engagement with the cable grounding conductor, there also being shown a receptacle cover secured over the receptacle with a screw fastener received in the grounding screw.

When installing the receptacle and assuming that all preliminaries have been properly carried out inclusive of support member and insulating covering placement and shield lay-back, the receptacle having been properly oriented is placed on top of the cable, it is pressed down to cause tabs 50, 52 to penetrate and pass through the flat conductor cable at the perforations 27 and 29 and register in openings 54, 56 of the insulating covering. Fastening screws 18 and 20 are inserted through the respective openings 41, the openings 41 in support member being threaded, and ground fastening screw 22 is received in body passage 60. The tip end of screw 22 is of conical configuration to facilitate its penetration of the protective shield 34, cable insulative covering and the grounding conductor 30 itself. Screw 22 passes through the receptacle as seen in FIGS. 3 and 4 and its widened head portion 120 engages in stopped abutment with the support block 72 and grounding contact means extension 92 the openings 96, 98 and 100 being sufficient only to accomodate the narrower shaft portion of the screw. All of screws 18, 22 and 20 are made up tight and this results in forcing the receptacle downwardly against the cable. As illustrated in FIG. 3, sufficient downward pressure is involved to result in the teeth 76 on the first portions 74 of the respective contacts piercing the cable coverings and coming into good electrically conductive contact with the cable live and neutral conductors 28 and 32. Since the support block 72 is free to move independently of the receptacle body the grounding contact teeth 90 can be, by tightening screw 22, urged into optimum electrically conductive contact with the protective shield 34 and also the cable grounding conductor 30 independently of the downwardly urging pressure of the receptacle and created by tightening screws 18 and 20. Upon such tightening of the grounding screw 22, a spacing 103 may exist between the upper surface of the support block 72 and the bottom surface of the recess 102 of the receptacle 10 indicative of the independence of those components in assembly. There is thus assured establishment of continuity in the grounding circuit, since the grounding screw itself is in good electrically conductive contact with the contact means. The widened head part 120 of screw 22 can itself be tapped for reception of a screw 124 used to secure a cover 126 in place over the receptacle.

Figure 7:
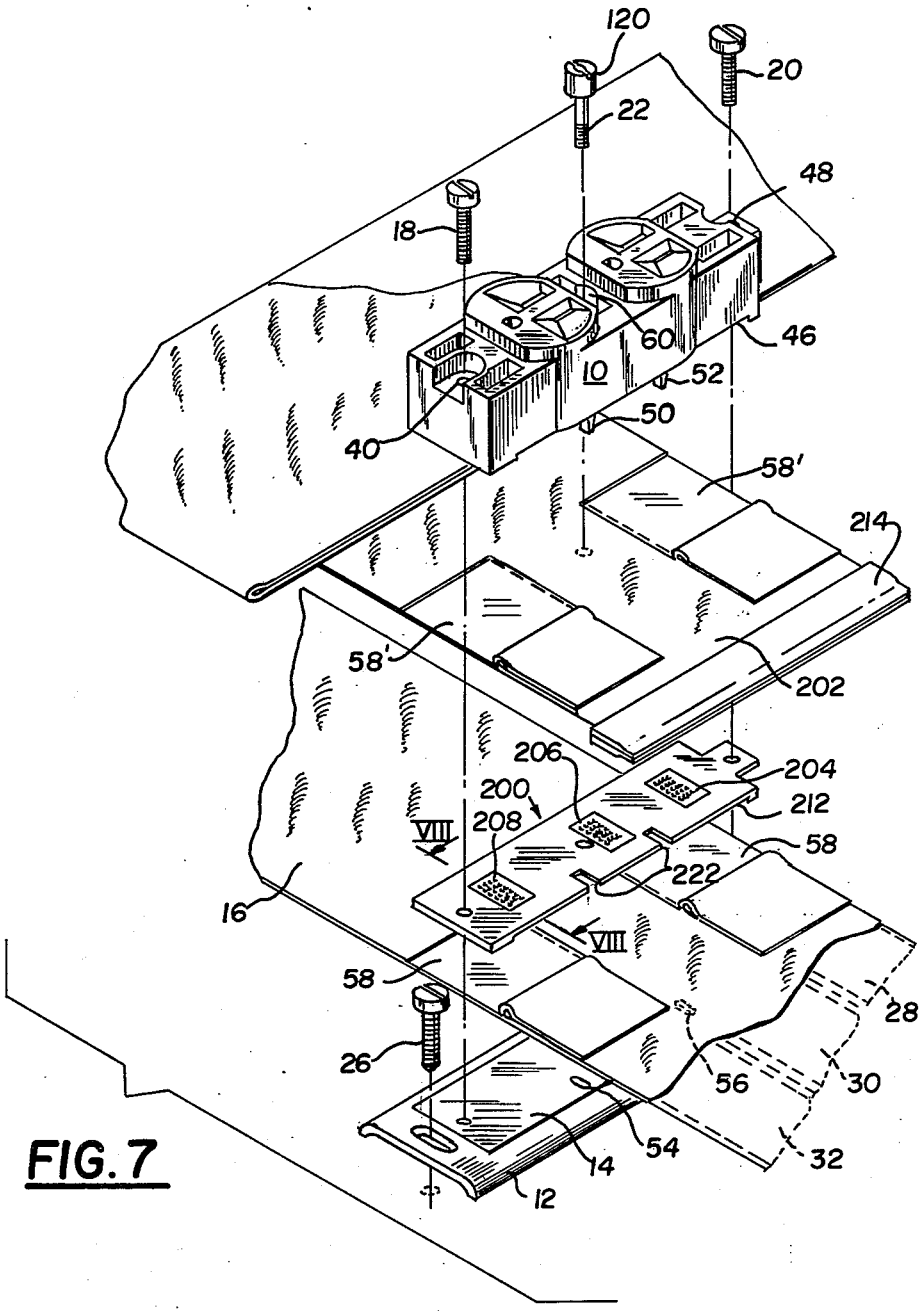
FIG. 7 is an exploded perspective view showing the components and illustrating the assembly procedures provided by the present invention and involved in effecting a tap or splice of a branch line cable conductor from a main conductor line at which a flat conductor cable receptacle is also to be located.
Figure 8:
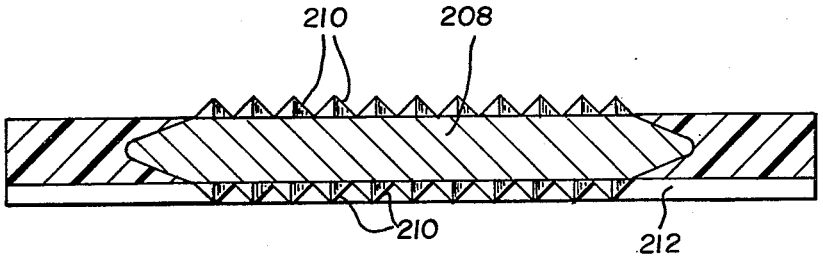
FIG. 8 is a sectional view taken along the line VIII—VIII in FIG. 7.

FIGS. 7 and 8 are illustrative of the method and device 200 of the present invention and used for effecting a tap or splicing of an additional run of flat conductor cable to a main wiring run of such cable at a location at which a power take-off receptacle is to be installed. In the exploded assembly view of FIG. 7 like reference numerals have been employed with respect to the like components as depicted in FIG. 1. When it is desired to effect a tap or splice of an additional run of cable 202 to the main run 16, the main run is positioned over support member 12 in the manner earlier described in connection with FIG. 1, its upper protective shield is cut and laid back over the live and neutral cable conductors as at 58 and an adapter device 200 carrying separate live, grounding and neutral insulation piercing type contact means 204–208 disposed on top of cable 16 with the contact means 204, 208 registered over the cut or laid back areas and the contact means 206 positioned registered above cable grounding conductor 30. The contact means have piercing teeth 210 extending upwardly and downwardly therefrom as can be best seen in FIG. 8. Adapter device 200 also is undercut as at 212 in the same manner and for the same purposes as described in connection with the notches 46 in receptacle 10 (FIG. 1). The additional run of cable 202 is then positioned on top of the adapter device with at least the course length thereof in the region or location at which the tap or splice is being made extending longitudinally of the main so that the respective conductors in the two cable runs are in stacked registry or in other words arranged to provide proper circuit polarity. The upper protective grounding shield of additional cable run 202 is laid back as at 58' in the areas overlying the live and neutral cable conductors in cable run 202 and in registry with the underlying contact means 204, 208. A portion of the bottom abrasion protective shield (not shown) is also laid back to preferably expose the cable across its width at a location opposite from the upper exposed areas 58'. Receptacle 10 is then disposed on top of cable run 202, the receptacle being constructed in the same manner as earlier described herein. The receptacle is then connected to support member 12 with fastener screws 18, 20 and 22 and when so connected clamps the cable runs 16 and 202 together causing the contact means 204–208 to pierce the insulation covering the main run 16 at the top side thereof (contact means 206 also pierces the protective grounding shield) and also to pierce the insulation covering at the bottom side of the additional cable run 202 and therewith electrically conductively connecting the conductors in the main run to the additional run. Similarly the insulation piercing contact means at the bottom side of receptacle 10 will be caused to pierce the coverings at the top side of cable run 202 to thereby establish electric circuit continuity to the receptacle for power take-off purposes. Receptacle 10 of course includes the same feature as previously described of capability of urging the grounding contact means therein into positive electrically conductive contact with the protective shield of cable run 202 and the grounding conductor therein independently of any downwardly urging force imparted to the receptacle body by screws 18 and 20. Cable run 202 can be cut adjacent the tap or splice and the cut end protected with end cap tape as at 214. The tap or splice run 202 can then be carried out to its ultimate course run by effecting a first fold therein in one direction crosswise to the main wire run and then a second fold in an opposite direction in the manner taught in U.S. Pat. No. 4,219,928 to thereby maintain the protective shield on the said cable run disposed at the top side thereof.

Adapter device 200, it will be noted, follows the general configurational outline of receptacle 10 and in operative position is in underlying registry with the receptacle. To insure proper orientation placement of the adapter device it has telltale means such as notches 222 which are receptive of the tabs 50 and 52 carried at the bottom of the receptacle.

Various modifications to the foregoing particularly described devices and method will now be evident to those skilled in the art, and may be introduced without departing from the invention. For example, the form of receptacle used at the location at which the tap or splice is made could be of construction other than that described for receptacle 10, provided it can be secured over the tap or splice in manner as assures effective insulation piercing contact of the respective conductors. Thus the foregoing preferred embodiments discussed and shown in the drawings are intended in an illustrative and not in a limiting sense. The true spirit and scope of the invention is set forth in the following claims.

I claim:

1. A method for effecting a tap or splicing of an additional run of flat conductor cable of the type having respective laterally spaced live, grounding and neutral conductors extending longitudinally of the cable to a main wiring run of such cable at a location at which a power take-off receptacle is to be installed, said method including positioning a support member under the main wiring run at said location, disposing an adapter device carrying separate live, grounding and neutral insulation piercing contact means on top of said main wiring run with the respective contact means thereof in registry with the corresponding conductors of said main wiring run, the said contact means having insulation piercing members extending outwardly from both the bottom and top sides of the adapter device, receiving the additional run of cable on top of said main wiring run with the respective conductors in each cable run in stacked registry, disposing a flat cable conductor receptacle having live, grounding and neutral conductor associated insulation piercing contact means at the underside thereof on top of said additional cable run with the respective receptacle contact means in registry over the corresponding adapter device contact means, and clamping the receptacle to said support member under a condition of sufficient downwardly directed constraint as to cause the adapter device carried contact means to pierce cable insulation covering at the top side of said main wiring run and at the underside of said additional cable run and therewith electrically conductively connecting the conductors in said main run with those of said addtional run, and to cause the receptacle carried contact means to pierce cable insulation covering the top side of said additional run to establish electric circuit continuity between said receptacle and said main and additional runs.

2. The method of claim 1 in which the main and additional cable runs are provided with a metallic protective grounding shield at one broad side thereof, the grounding shield of each facing upwardly and the protective shield on both said main and additional cable runs in the regions thereof intended to register with the respective adapter device and receptacle live and neutral cable conductor associated contact means is cut and laid back on adjacent shield regions prior to disposition the said adapter device and receptacle thereon.

3. The method of claim 2 in which the additional cable run is folded back on itself in a first direction crosswise to the main run and then folded a second time in an opposite direction to maintain the protective shield side thereof facing upwardly throughout the course of said additional run.

4. A method for effecting a tap or splicing of an additional run of flat conductor cable of the type having respective laterally spaced live, grounding and neutral conductors encased in insulation and extending longitudinally of the cable to a main wiring run of such cable having a flat elongate metallic ground shield extending thereover, said method comprising the steps of:

displacing a portion of said metallic ground shield adjacent said live and neutral conductors of said main wiring run, thereby exposing insulation adjacent such live and neutral conductors;

disposing an adapter device carrying separate live, grounding and neutral contact means on top of said main wiring run with the respective contact means thereof in registry with the corresponding conductors of said main wiring run, said contact means extending outwardly from both the bottom and top sides of the adapter device, contact means in registry with the live and neutral conductors being placed on said exposed cable insulation of said main run and contact means in registry with the ground conductor being placed on said metallic ground shield, receiving the additional run of cable on top of said main wiring run and said adapter device with the respective conductors in each cable run being in stacked registry, and clamping the additional run and main run under a condition of sufficient force as to cause the adapter device contact means to pierce cable insulation at the top side of said main wiring run and engage the live and neutral conductors therein and to engage the metallic ground shield adjacent the ground conductor, and at the underside of said additional cable run to pierce cable insulation and engage the live, grounding and neutral conductors, respectively therein, thereby electrically conductively connecting the live and neutral conductors in said main run with those of said additional run and the metallic ground shield with the grounding conductor of said additional run.

5. A method according to claim 4, wherein said clamping is effected to cause the contact means on the adapter device in registry with the ground conductors of the main and additional runs to extend through the metallic ground shield and pierce insulation at the top side of said main wiring run and engage the grounding conductor of said main wiring run.

6. A method according to claim 4, wherein said displacing of said metallic ground shield adjacent said live and neutral conductors is effected by cutting a portion of said shield adjacent each such live and neutral conductors and folding such cut portions back onto themselves.

7. A tap or splice assembly comprising:

a first flat elongate multiconductor cable having a plurality of longitudinally extending laterally spaced conductors encased in insulation defining upper and lower major surfaces;

a metallic shield overlying said upper surface of said first cable and having a width of extent at least sufficient to span the lateral expanse of said conductors of said first cable;

a second flat elongate cable having a plurality of longitudinally extending laterally spaced conductors encased in insulation defining upper and lower major surfaces, said second cable lying over the metallic shield and in longitudinal alignment with the first cable such that conductors of said first cable are in longitudinal registry with conductors of said second cable;

an adapter having a substantially planar elongate insulative body and a plurality of conductive members spaced longitudinally therealong, said conductive member including contact means projecting from both major surfaces of said planar body, said adapter being interposed between the lower surface of said second cable and said metallic shield with the conductive members being in registry with the respective cable conductors that are aligned in longitudinal registry, a first conductive member being adjacent a portion of said metallic shield;

a portion of said metallic shield adjacent a second conductive member being displaced, thereby exposing a portion of the upper surface of said first cable; and means compressing said first and second cables, said metallic shield and said adapter together such that contact means on said first and second conductive members penetrate through the insulation on the lower surface of said second cable and engage respective conductors therein and contact means on said second conductive member penetrates through the exposed portion of said upper surface of said first cable and engages a conductor therein and contact means on said first conductive member electrically contacts a portion of said metallic shield.

8. An assembly according to claim 7, wherein said contact means on said first conductive member includes means extending through said metallic shield, piercing said insulation adjacent of said first cable and engaging a conductor therein.

9. An assembly according to claim 7, further including a metallic shield overlying said second cable and electrically connected at such assembly to one of said conductors of either said first or second cables.

10. An assembly according to claim 7, wherein said compressing means includes an electrical receptacle disposed on said first cable including contact means making separate electrical connection to respective conductors of said second flat cable.

11. An assembly according to claim 10, wherein said compressing means includes a support member disposed beneath said first cable and means securing said receptacle to said support member.

12. An assembly according to claim 11, wherein said means securing said receptacle to said support member includes a threaded member and wherein said adapter body has an opening therethrough in receipt of said threaded member.

13. An assembly according to claim 12, wherein said threaded member extends through said opening in said adapter body and further extends through a conductor of both said first and second cables.

14. Apparatus for use when effecting a tap or splicing an additional run of flat conductor cable of the type having respective laterally spaced live, grounding and neutral conductors extending longitudinally of the cable to a main wiring run of such cable, comprising:

a metallic support member adapted to be placed under the main wiring run;

an adapter device carrying separate live, grounding and neutral contact means adapted to be disposed on top of the main wiring run with the respective contact means thereof being in registry with the corresponding conductors of the main wiring run, said contact means having insulation piercing members extending outwardly from both the bottom and top sides of the adapter device, the insulation piercing members extending from the lower side adapted to pierce insulation and engage the respective conductors of the main wiring run and the insulation piercing members extending from the top side adapted to pierce insulation and engage respective conductors of the additional wiring run that is disposed over such adapter device in manner such that the respective live, grounding and neutral conductors of the additional and main wiring runs are in longitudinal registry; and clamping means for applying sufficient force as to cause the insulation piercing members of said adapter device to pierce insulation and engage the respective conductors of said additional and main wiring runs, the clamping means including a conductive grounding member having extent for extending through the grounding conductors of both the additional and main wiring runs and for making electrical and mechanical connection to said metallic support member, whereby said support member is electrically at ground potential.

15. In combination, an adapter device for use when effecting a tap or splicing an additional run of flat conductor cable of the type having respective laterally spaced live, grounding and neutral conductors extending longitudinally of the cable to a main wiring run of such cable, said device including an elongated holder of electrically insulative material, and separate live, grounding and neutral cable conductor associated contact means carried in said holder at spaced longitudinal positions thereon in correspondence to the lateral spacing of the conductors in said cable runs, said contact means having insulation piercing members extending outwardly therefrom at the opposite sides of said holder and effective when said holder is interposed between longitudinally aligned courses of said main and additional cable runs and clamped together under pressure applied to said aligned courses to pierce insulation covering the conductors in said cable runs and contact said conductors in each to electrically conductively connect the conductors of one run to those of the other; and an electrical receptacle being adapted to be received on top of said additional cable run at the location where said adapter device is interposed between said main and additional cable runs, said receptacle having insulation piercing contact means at the underside thereof and constituting a clamping pressure member for applying pressure to said aligned cable courses when the receptacle is secured to a support member underlying the main wiring run, the contact means of said receptacle piercing cable insulation at the top side of said additional cable run for electrically conductively connecting the conductors in said additional cable run with said contacts and therewith establish electric circuit continuity between said receptacle and said main and additional runs.

* * * * *